United States Patent [19]

Hametner et al.

[11] 4,187,889

[45] Feb. 12, 1980

[54] WIRE PINCH MARK DETECTOR FOR USE IN METHOD AND APPARATUS FOR SEMIAUTOMATICALLY MANUFACTURING ELECTRICAL WIRE HARNESS

[75] Inventors: Albert L. Hametner, Seattle, Wash.; Mark S. Soderberg, Ketchum, Id.

[73] Assignee: The Boeing Company, Seattle, Wash.

[21] Appl. No.: 933,244

[22] Filed: Aug. 14, 1978

[51] Int. Cl.[2] ..... B21F 23/00

[52] U.S. Cl. ..... 140/92.1; 29/715; 29/753; 340/677

[58] Field of Search ..... 340/673, 674, 675, 677; 140/92.1, 93 R; 29/714, 715, 753; 242/7.17, 7.18; 72/5

[56] References Cited

U.S. PATENT DOCUMENTS

| | | | |
|---|---|---|---|
| 2,685,626 | 8/1954 | Zwack | 340/677 |
| 2,735,945 | 2/1956 | Colton et al. | 340/675 |
| 3,557,615 | 1/1971 | Seymour, Jr. et al. | 340/677 |
| 3,739,276 | 6/1973 | Dornberger | 340/677 |
| 3,804,130 | 4/1974 | Tarbox et al. | 140/93 R |
| 3,827,296 | 8/1974 | Hidaka | 340/677 |

*Primary Examiner*—Lowell A. Larson

*Attorney, Agent, or Firm*—Conrad O. Gardner; B. A. Donahue

[57] ABSTRACT

A method and apparatus for identifying and detecting the end of a wire segment in a computer controlled harness maker in which the wire is crimped twice in close proximity 90 degrees apart thereby forcing the wire next to the crimp to enlarge in size. The crimped wire is then pulled between two surfaces of the pinch mark detector which are spring loaded and rides at the nominal wire diameter until the crimp passes through the pinch mark detector depressing a plunger to activate a metal sensitive proximity switch providing an output signal representative of a pinch mark detect condition.

5 Claims, 9 Drawing Figures

Fig. 3
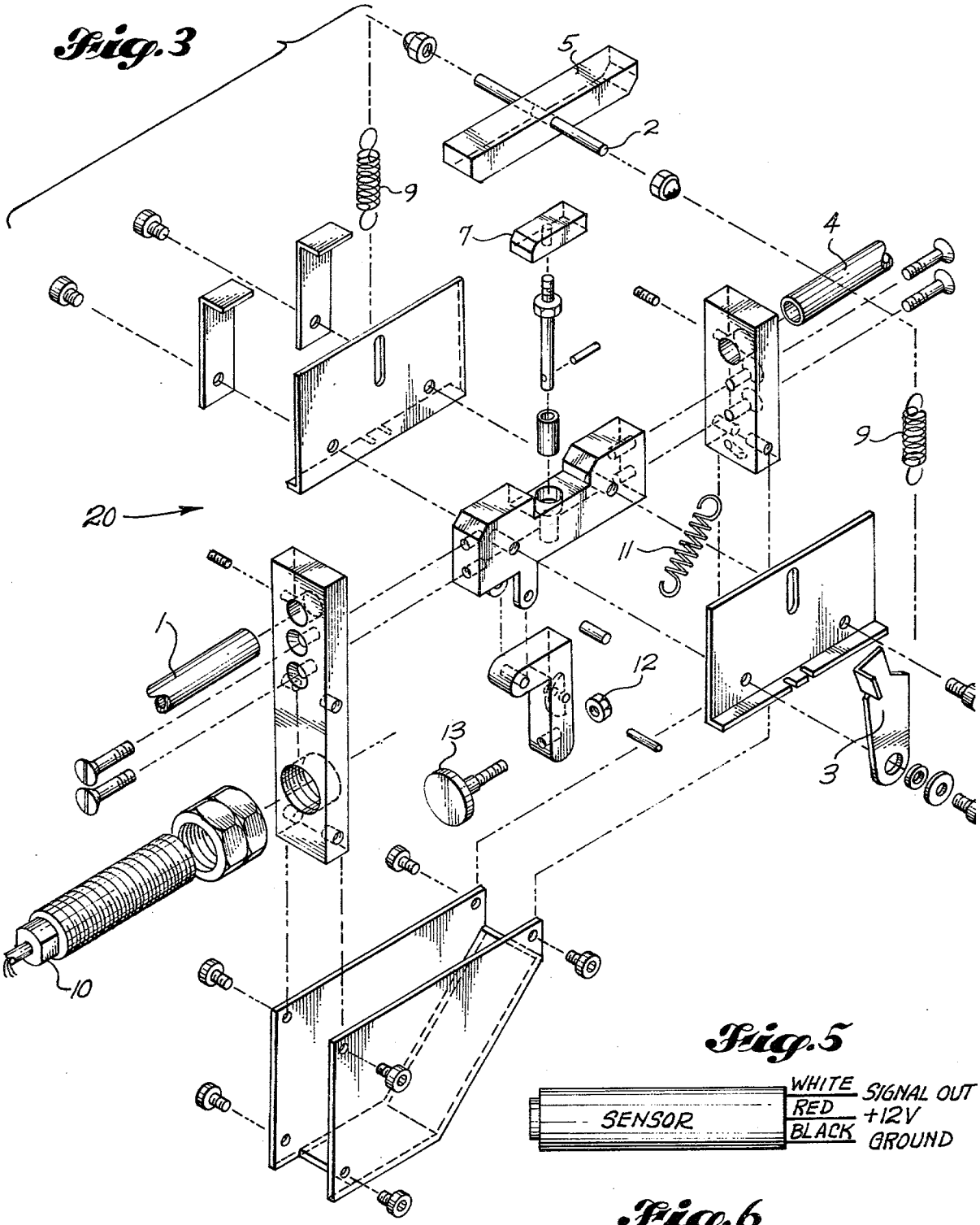
Fig. 5
Fig. 6
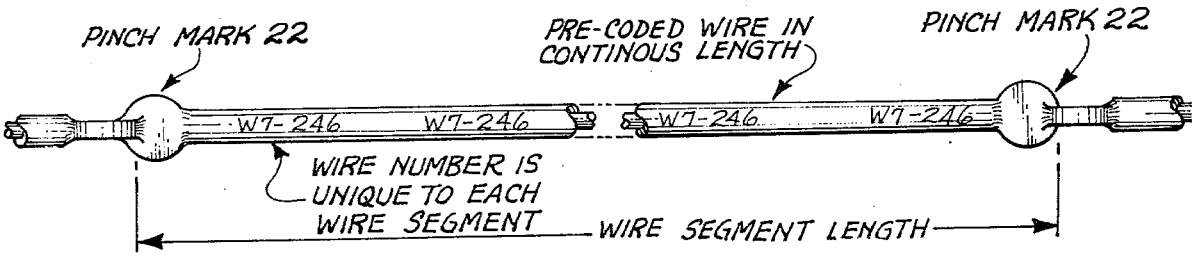

WIRE PINCH MARK DETECTOR FOR USE IN METHOD AND APPARATUS FOR SEMIAUTOMATICALLY MANUFACTURING ELECTRICAL WIRE HARNESS

This invention relates to electrical wire harness making and more particularly to apparatus for wire length control in wire harness making.

Heretofore cables have been deformed to provide alarm functions in logging systems such as shown in U.S. Pat. No. 3,052,878 issued Sept. 4, 1962. A method for assembling electrical wire harnesses where a pinch mark is applied to an individual wire portion is shown in U.S. Pat. No. 3,842,496 issued Oct. 22, 1974 and also assigned to the assignee of the instant application, The Boeing Company.

System knowledge of individual wire lengths by means of feedback path control via pinch mark detector information has heretofore prevented cumulative error and consequent wire loss in wire harness assembly such as shown in the aforementioned U.S. Pat. No. 3,842,496.

It is accordingly an object of the present invention to provide pinch mark detection information for use in methods and apparatus for semiautomatically manufacturing electrical wire harnesses.

It is a further object of this invention to provide a pinch mark detector for wire having 90 degree spaced apart crimps.

It is yet another object of this invention to provide means for generating length and pinch mark detection representative signals for use in controlling a movable wire laying head assembly in the event of wire segment length in excess of a predetermined value.

Further objects and advantages of the present invention will become apparent when reference is now made to the following detailed description taken with the accompanying drawings wherein:

FIG. 3 is an exploded view of the pinch mark detector of FIGS. 1A and B included to enable complete detailed assembly thereof;

FIG. 5 is an electrical schematic diagram of the metal sensitive proximity switch utilized in the pinch mark detector of FIGS. 1A and B; and, FIG. 6 is illustrative of an entire wire segment terminated with crimped end portions of the type shown in FIGS. 2A, B, and C.

Figure 1A:
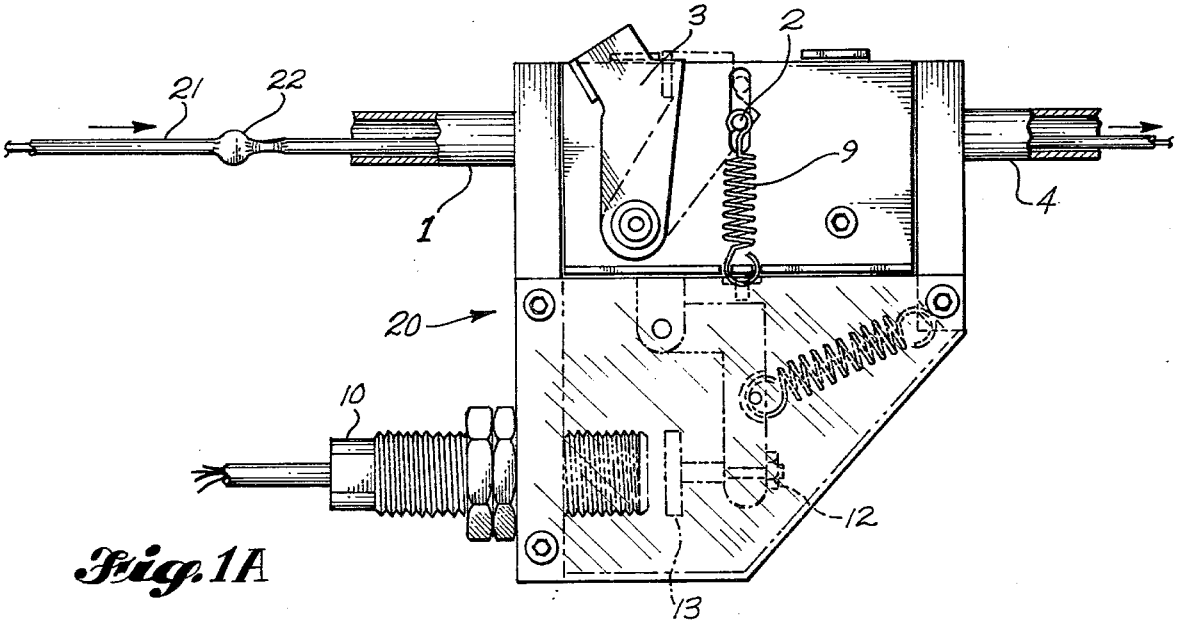
FIG. 1A is a side view of the present pinch mark detector apparatus.

Turning now to FIGS. 1A and B, it can be seen that pinch mark detector 20 includes wire feed tube 1 through which wire 21 having pinch marks 22 (shown in more detail in FIGS. 2A, B, and C) is pulled through pinch mark detector 20 exiting through wire exit guide tube 4. Reference to FIG. 4 will show that precoded pinch marked wire 21 is being payed out from a holding spool and layed down on the formboard shown, the spool containing wire 21 shown is under control of the computer 31 controlled harness cable forming machine 33 which coupled to servo system 35 routes wire 21 on the formboard shown in FIG. 4 details and functions of which may be fully understood when aforementioned reference U.S. Pat. No. 3,842,496 is completely read and more particularly column 5 beginning at line 43 on. With continuing reference to FIG. 4 it should be particularly noted that the features of the present embodiment leading to improvements provided over the system shown in U.S. Pat. No. 3,842,496 flow from pinch mark detector 20 shown in FIG. 4 and signals 37 and 39 representative respectively of pinch mark detection and wire measuring hereinafter described in more detail which provide feedback information to computer 31 controlled harness cable forming machine 33.

Figure 1B:
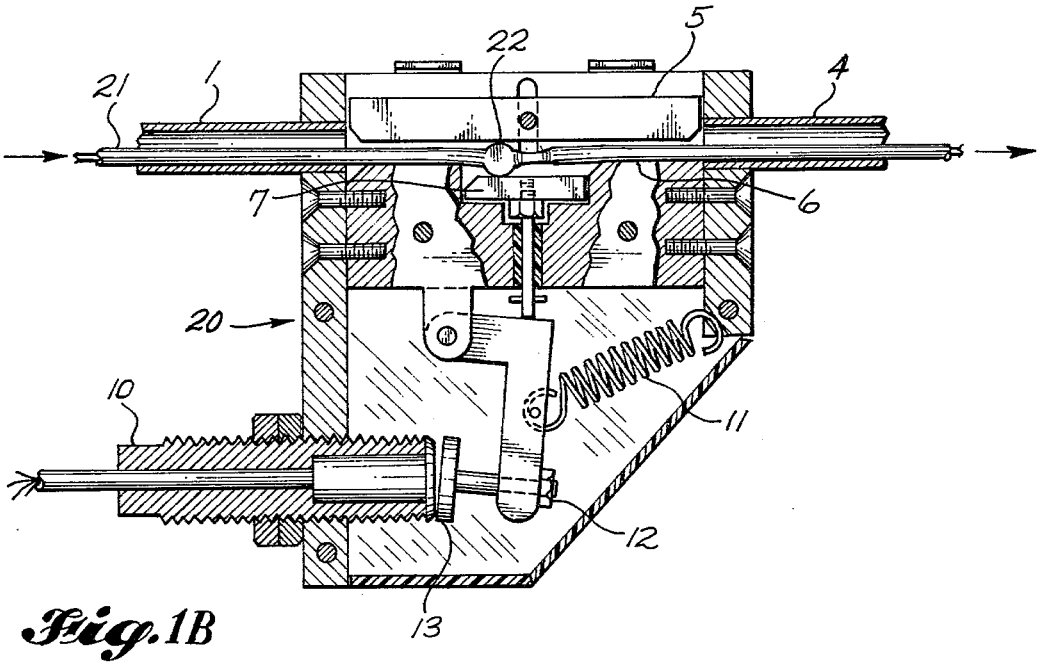
FIG. 1B is a side view of the present pinch mark detector apparatus showing detailed movement of internal component parts during pinch mark detection.

Returning now to FIGS. 1A and B it will be noted that to facilitate easy loading, pressure shoe 5 is pulled back and latched open (as shown in FIG. 1B) by latching means 3. Upon passage of wire 21 from feed tube 1 through exit guide tube 4, latching means 3 can then be released which allows pressure shoe 5 to come in contact with wire 21 thereby pressing wire 21 tight against fixed anvil 6. Wire 21 is now captured between pressure shoe 5 and fixed anvil 6 as shown in FIG. 1B. As wire 21 moves through pinch mark detector 20, pinch marks 22 (also shown in perspective in FIG. 2A) are detected when pinch marks 22 depress plunger 7 thereby moving detector lever arm 8 into the sensing zone of proximity sensor 10 thereby generating an output signal (as seen from FIG. 5 showing the details of lead connections of sensor 10).

Metal sensing detector 10 can comprise an all metal sensitive proximity switch e.g., a Micro Switch Model FY AA3Al-2. Plunger 7 will always be depressed by a pinch mark because spring tension of spring 9 on pressure shoe 5 is greater than spring 11 pressure on lever arm 8. Spring 9 forces pressure shoe 5 tight against anvil 6. Plunger 7 is mechanically adjusted to be level with the surface of anvil 6. Only pinch marks will depress plunger 7 and move lever arm 8 supporting metal surface 13 by fastening means 12 into the sensing zone of proximity sensor 10. Pressure shoe 5 holds wire 21 flat against anvil 6 and only pinch marks depress plunger 7. It can thus be seen that size variations in wire 21 have no effect on plunger 7 movement, therefore pinch mark detector 20 is adaptable for use with a range of wire sizes. The present embodiment successfully provided detection of pinch marks that were 0.020 inches greater than the O.D. of the wire, the limiting factors in detection being: the sensitivity of proximity sensor 10 and also mechanical precision in construction of pinch mark detector 20. The physical and geometrical properties of the pinch mark that are required to assure detection are: two pinch marks, each of which is located in planes that are at right angles to each other. From FIGS. 2B and C it can be observed that pinch marks must be pinched deep enough to raise the insulation sufficiently that when wire 21 is captured between anvil 6 and pressure shoe 5, a minimum of 0.020 inch differential between wire O.D. and pinch mark is maintained.

Turning now to FIG. 4 it can be seen how the aforementioned pinch mark detector 20 can provide information signals which enable detection of and corrections for measurement inaccuracies which would otherwise occur in the system of U.S. Pat. No. 3,842,496 in which pre-coded wire is used on the computer 31 controlled harness cable forming machine (CCHM) which by servo system 35 movement of wire 21 pays off the spool around the formboard pins on the formboard.

Now, importantly, for proper registrations on formboards, wire length segments must be accurate. A wire segment as seen in FIG. 6 is bounded on each end by pinch marks 22. When the harness is formed, pinch marks 22 should be within plus or minus 2 inches of the formboard pins shown in FIG. 4. Because of the difficulties in maintaining accuracy on pre-measured wire as cut in systems such as shown in aforementioned U.S. Pat. No. 3,842,496, a wire length compensation control system including the feedback information signals control loop (including inputs provided by pinch mark detector 20 and length encoder 41 coupled in the feedback path with signal conditioning and waveshaping circuit means) was provided to computer 31 controlled CCHM controller 33 as shown in FIG. 4.

Figure 2A:
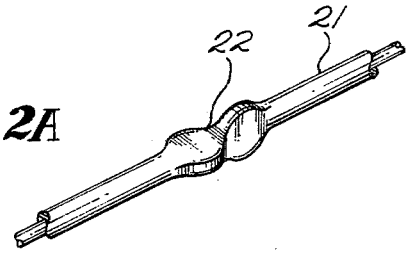
FIG. 2A shows spaced apart flattened portions of a wire segment in 90 degree planes with respect to the central axis of the wire segment.
Figures 2B, 2C, 4:
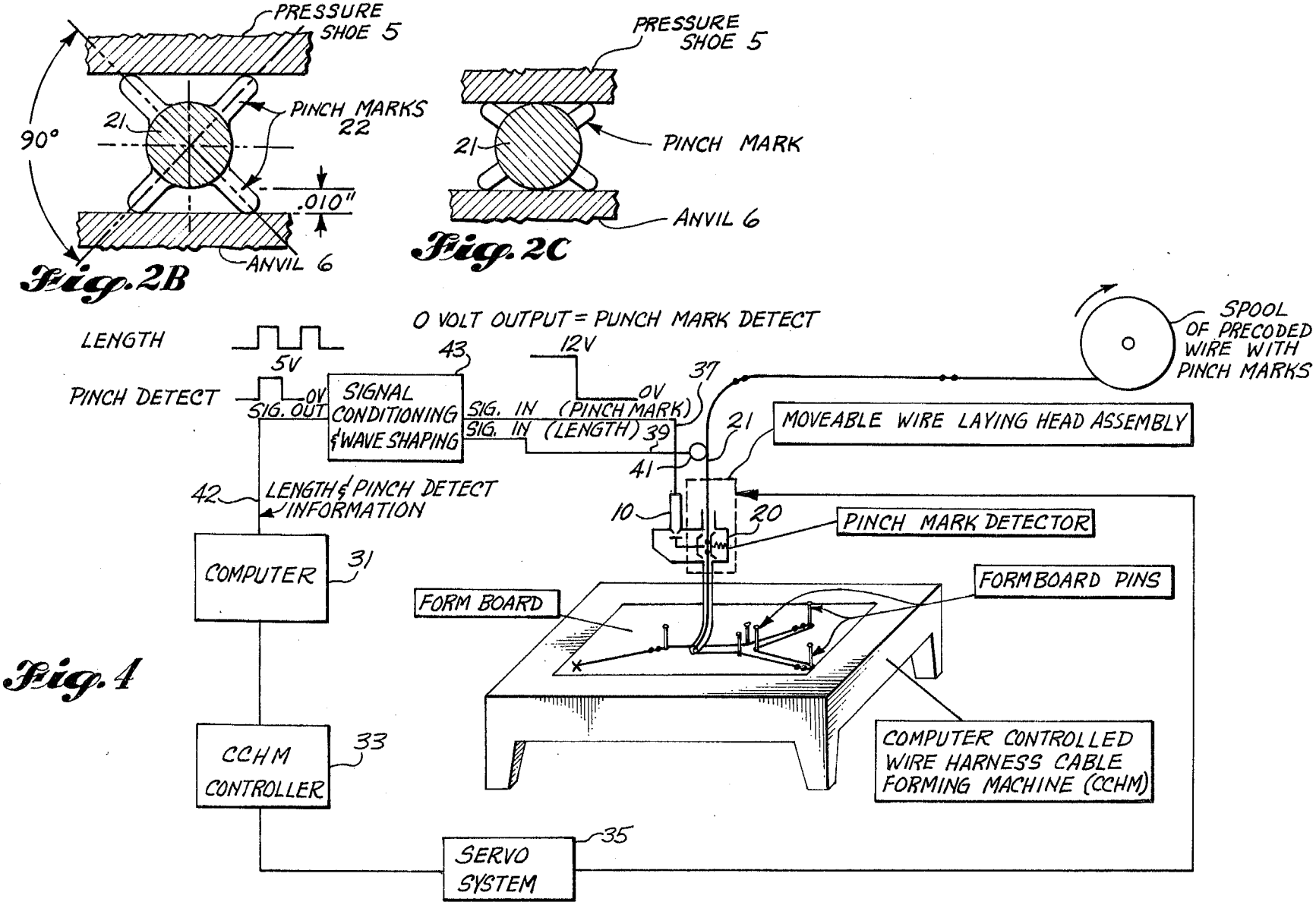
FIG. 2B is an end view of the wire segment of FIG. 2A shown during detection position in the pinch mark detector of FIGS. 1A and B.
FIG. 2C is an end view of the wire segment of FIG. 2A shown in a nondetection position in the pinch mark detector of FIGS. 1A and B.
FIG. 4 is a schematic system diagram showing utilization of the present pinch mark detector apparatus of FIGS. 1A and B in wire harness cable forming.

As the wire harness is formed by CCHM controller 33, wire is pulled from the spool of precoded wire with pinch marks pinched as shown in FIGS. 2A, B and C, and premeasured and containing all the wires required to make the wire harness. Different gauges and wire types are end for end on this spool. Computer 31 running CCHM controller 33 knows (as can be seen for a reading of U.S. Pat. No. 3,842,496) the correct length of each wire segment however previously as in the aforereferenced patent, feedback of wire lengths information was not available to computer 31. In the improved system of FIG. 4, information required by computer 31 to verify and make all the necessary corrections is available. At a predetermined distance from a formboard pin, length encoder 41 is enabled by computer 31 and measurement of wire 21 begins. Upon initiation of this measuring mode computer 31 is responsive to recognition at input 42 of a pinch mark signal. A pinch mark detected in pinch mark detector 20 causes the output signal level of proximity sensor 10 to change from 12 volts to 0 volts. Signal conditioning and waveshaping circuit means 43 converts pinch mark detector voltage detect level to provide a pulse output of e.g. 5 volts as shown at the output of signal conditioning and waveshaping circuit 43. Signal conditioning and waveshaping circuit means 43 also converts wire length information from length encoder 41 into a series of pulses as shown at the output of signal conditioning and waveshaping circuit 43 so that these two pulse information signals representative of length and pinch detect information may be utilized by computer 31 controlled CCHM controller 33. When computer 31 receives a signal representative of pinch mark detect, the number of length pulses received from the length encoder is recorded. Now, the number of pulses recorded from the time of length encoder enable hereinbefore mentioned to pinch mark detect and noting the distance from pinch mark detector 20 to the end of exit feed tube 4, calculation by computer 31 of how many inches the pinch mark is from any given formboard pin is readily calculated. One of three conditions will result from the aforementioned calculation provided through the feedback path viz. (1) the wire segment is too short, (2) the wire is within plus or minus 2 inches from the formboard pin, or (3) the wire is too long. If wire 21 is too short computer 31 will stop CCHM controller 33 operation and by manual operation, replacement of the short wire segment is required. A short wire segment may result from a missing wire segment thus providing a self-checking feature. If the wire segment falls within ±2 inches of the formboard pin, computer 31 will continue operation. If the wire segment is too long the computer will send information to CCHM controller 33 which in turn provides correction control of wire 21 on the formboard by way of servo system 35. To compensate for excessive wire length CCHM controller 33 will cause an extra wrap via. servo system 35 to be made around a formboard pin to remove excess length. More than one wrap may be necessary. The maximum number of wraps permitted may be limited to prevent excessive wrapping. After wrapping when necessary is completed, wire harness forming continues. No operator intervention as a consequence is required for a long wire unless the maximum allowable wraps are reached.

Because of the measuring system used to precode and premeasure wire length segments as in the aforementioned prior art system of U.S. Pat. No. 3,842,496, wire length segment lengths always tend to be long. By a small percentage therefore, the wrapping process hereinabove described prevents accumulation of wire length error from each segment. At the end of each segment, computer 31 will make the immediately hereinabove described pinch mark detect check and enable the necessary corrections when necessary.

We claim:

1. In the method of assembling electrical wire harnesses wherein an elongate wire segment having two pinch marks representative of the end thereof is withdrawn from a storage zone and laid onto a formboard along a predetermined path toward a formboard pin, the steps of detecting and compensating for excess wire segment length of said elongate wire segment comprising:

enabling a length encoder for measuring said elongate wire segment while said wire segment is laid onto the formboard along a predetermined path toward said formboard pin;

providing pinch mark detector detection when enabling said length encoder; and then, making one or more wraps of the end of said elongate wire segment around said formboard pin when said length encoder and pinch mark detector are indicative of said elongate wire segment having an end thereof exceeding a predetermined distance beyond said formboard pin.

2. The method of claim 1 wherein said predetermined distance equals about two inches.

3. A pinch mark detector apparatus for use in detecting pinch marks representative of the end of a wire segment comprising:

a wire feed tube;

a wire exit guide tube;

an anvil;

a spring biased pressure shoe including latching means operatively associated therewith adapted for latching in an open position for passage of an elongate wire through said wire feed tube and said wire guide tube, said latching means further adapted to be released thereby allowing said pressure shoe to contact said elongate wire thereby passing said elongate wire segment against said anvil;

a plunger;

a proximity sensor having a sensing zone;

a spring biased lever arm having a first portion abutting said plunger and a second portion disposed for supporting a metallic surface so that pinch marks on said elongate wire contacting said plunger depress said plunger thereby moving said metallic surface into said sensing zone.

4. The pinch mark detector apparatus of claim 3 wherein the spring tension of said spring biased pressure shoe is greater than the spring pressure on said spring biased lever arm.

5. Apparatus for generating wire length and pinch detect information from an elongate wire transmitted along a predetermined path comprising:

a pinch mark detector coupled to said elongate wire along said predetermined path for providing signals representative of a pinch detect condition of said elongate wire;

a length encoder coupled to said elongate wire along said predetermined path for providing signals representative of elongate wire length; and, signal conditioning and waveshaping means responsive to said signals representative of pinch detect condition and elongate wire length for providing pulse information representative of pinch detect and elongate wire length.

* * * * *